United States Patent [19]

Drew

[11] Patent Number: 4,563,787

[45] Date of Patent: Jan. 14, 1986

[54] PRODUCTION OF INSOLES

[75] Inventor: John A. Drew, Barnham, England

[73] Assignee: John Drew (London) Limited, Barnham, England

[21] Appl. No.: 585,551

[22] Filed: Mar. 2, 1984

[30] Foreign Application Priority Data

Mar. 8, 1983 [GB] United Kingdom ..... 8306294

[51] Int. Cl.[4] ..... A61F 5/14; A43B 13/38

[52] U.S. Cl. ..... 12/142 N; 12/146 M; 36/43; 128/595; 128/581

[58] Field of Search ..... 36/43, 1, 88, 93, 44; 12/146 M, 142 N; 128/595, 581, 596

[56] References Cited

U.S. PATENT DOCUMENTS

| | | | |
|---|---|---|---|
| 2,742,657 | 4/1956 | Sloane | 128/595 |
| 3,135,265 | 6/1964 | Holzman | 128/595 |
| 3,292,277 | 12/1966 | Teschon | 128/595 |
| 3,825,017 | 7/1974 | Scrima | 128/595 |
| 3,895,405 | 7/1975 | Edwards | 36/43 |
| 4,463,761 | 8/1984 | Pols et al. | 36/88 |

FOREIGN PATENT DOCUMENTS

| | | | |
|---|---|---|---|
| 520761 | 7/1953 | Belgium | 128/595 |
| 583683 | 12/1946 | United Kingdom | 128/595 |

OTHER PUBLICATIONS

Quickie Sandal Instruction Booklet, Dec. 1972.

*Primary Examiner*—Werner H. Schroeder
*Assistant Examiner*—Steven N. Meyers
*Attorney, Agent, or Firm*—Leydig, Voit & Mayer Ltd.

[57] ABSTRACT

A shoe or sandal is chosen which fits the patient's foot. One or more blanks of thermosoftening expanded plastics (e.g. an expanded cross-linked polyethylene) for constituting the insole are heated above the softening temperature and inserted in the shoe. The shoe is fitted on the patient's foot and the patient is walked until the insole is below the softening temperature. The insole may remain in the shoe or may be transferred to the patient's own footwear.

3 Claims, 7 Drawing Figures

PRODUCTION OF INSOLES

TECHNICAL FIELD

This invention relates to a method of producing an insole for relieving pressure or giving support.

BACKGROUND ART

The use of thermosoftening expanded plastics, such as "Plastazote" (a trade mark for expanded cross-linked polyethylene), for insole making is well known. Typically, the patient's foot is pressed against a sheet of "Plastazote" which has been heated to 140° C. and the moulded area is then cut out and ground to the required shape before being glued into an orthopaedic shoe.

The use of thermoplastic foams, i.e. Plastazote, for insole making is well documented. There are, however, many situations where, due to lack of applicator skill and/or fabrication facilities, e.g. glueing and grinding, many patients do not benefit from correct total contact insoles.

DISCLOSURE OF INVENTION

We have found by experience that, to obtain most beneficial plantar surface pressure redistribution effects, a cast taken from a dynamically moulded, i.e. previously worn, insole is more readily comfortable and lasts longer. This is, however, a necessarily lengthy process both in terms of ultimate patient supply time and in manufacturing time.

The present invention provides a method of producing an insole conforming to a patient's foot, in which a shoe is chosen which fits the foot, one or more blanks of thermosoftening expanded plastics for constituting the insole are heated above the softening temperature and inserted in the shoe, the shoe is fitted on the patient's foot, and the patient is walked until the insole is below the softening temperature.

Preferably the plastics is adhesive above its softening temperature. In this case the insole will automatically adhere to the shoe. The shoe may conveniently be a sandal and is preferably made of flexible thermosoftening expanded plastics, such as "Plastazote", preferably of higher density than the insole.

The invention also provides a kit comprising a plurality of shoes (preferably sandals) of various sizes and fittings, made of flexible thermosoftening expanded plastics, and a plurality of insole blanks which can be fitted into the shoes, the blanks being of thermosoftening expanded plastics.

The invention will be described further, by way of example, with reference to the accompanying drawings

BEST MODE FOR CARRYING OUT THE INVENTION

Figure 6:
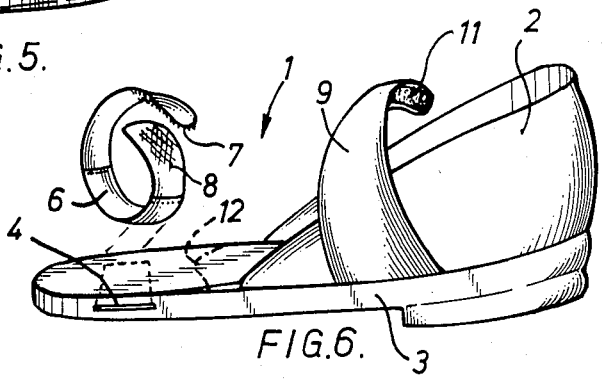
FIG. 6 is a perspective view of a sandal for a right foot.
Figure 7:
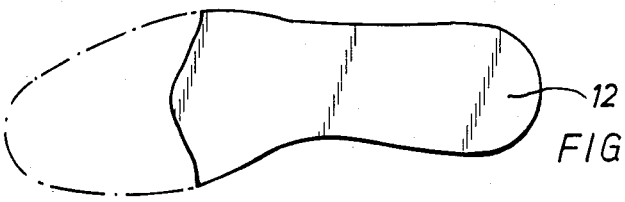
FIG. 7 is a plan view of a middle sole unit of the sandal.

By way of example, the drawings illustrate the production of one type of valgus insole. A sandal 1 (FIG. 6) which best fits the patient's foot is chosen from a plurality of similar sandals of different sizes and fittings. The sandal is made of medium density "Plastazote" and comprises a one-piece heel cup 2 fixed to a sole-and-heel unit 3 having a transverse slot 4 through which a toe or forepart strap 6 extends. The slot 4 is wider than the strap 6 so that the position of the strap is adjustable for differently shaped feet. The strp 6 is elastic in order to accommodate various depths of forefoot. The strap 6 has a "Velcro" hook tape 7 and a "Velcro" loop tape 8 ("Velcro" being a trade mark). The broad base of a valgus moulding strap 9 is fixed to the hind part of the sole-and-heel unit 3 and the strap 9 curves high over the dorsum of the foot. The free end of the strap 9 has a "Velcro" loop tape 11 for attachment to a "Velcro" hook tape (not visible) on the heel cup 2.

The sandal also has a middle sole unit 12 of fiber board or high density "Plastazote", which extends only over about three-quarters of the length of the sole-and-heel unit 3 and is curved by a thin layer of soft, low density "Plastazote". The front edge of the unit 12 is shaped to correspond to the profile of the metatarsal heads. The middle sole unit 12 allows an exaggeration of the moulding movement of the metatarsal heads during formation of the insole as described below; this is important for the dynamic shaping of the insole.

Figure 1:
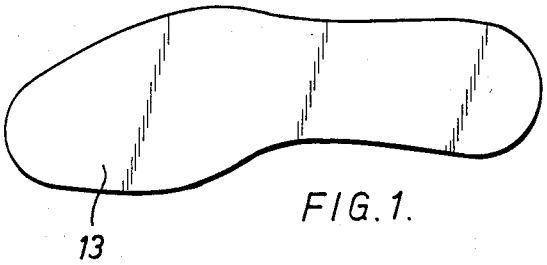
FIG. 1 is a plan view of an insole blank for a right foot.
Figure 2:
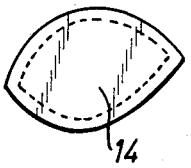
FIG. 2 is a plan view of an auxiliary insole blank.
Figure 3:
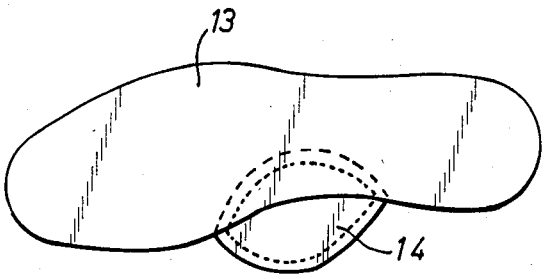
FIG. 3 is a plan view of the two blanks combined.
Figure 4:
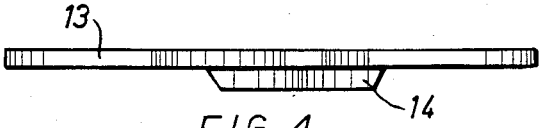
FIG. 4 is a side view of the two blanks combined.
Figure 5:
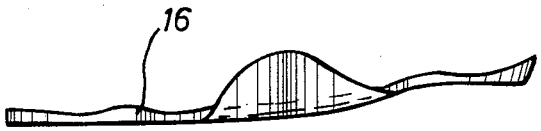
FIG. 5 is a side view of the resulting insole.

An insole blank 13 which fits the sandal and has the density required to suit the patient's condition is chosen from a plurality of similar blanks of various sizes and densities, made of "Plastazote". A pre-cut and skived valgus insole blank 14 is also selected. The two blanks 13,14 are juxtaposed (FIGS. 3 and 4) and heated to 140° C. for two minutes, whereupon they become soft and autoadhesive. The two blanks 13,14 are then inserted into the sandal 1, which is then put on the patient's foot. The patient walks while the blanks cool to below the softening temperature of the "Plastazote". The pressure and flexing of the patient's foot causes the blanks to be dynamically moulded into the insole 16 shown in FIG. 5. The lateral quarter of the heel cup 2 is extended far enough forward to support the valgus blank 14 while it is moulded by the patient's foot into a smooth complex curve, free of creases and scores, behind the first metatarsal head and up the medial aspect of the first metatarsal bone. The use of the pre-skived blank 14 thus allows a smooth insole to be produced without anomalous lumps or edges.

Various modifications may be made in the form of the insole by selecting different combinations of insole blanks. There are several types of valgus insole as well as other specialised insoles for specific plantar surface pressure redistribution, e.g. metatarsal insole, or hind foot correction, or containing and/or compensatory functions that can be made by the simple technique described above.

The insole produced can be transferred to the patient's own footwear with only minimal adjustment.

Alternatively, provided the sole and heel unit of the sandal is sufficiently hard-wearing (e.g. being of microcellular plastics material commonly used for the soles of footwear), the insole can be left in the sandal, which can then continue to be worn by the patient.

I claim:

1. A method of producing an insole conforming to a patient's foot comprising the steps of choosing a shoe which fits the foot, providing the shoe with a middle sole unit extending from the heel region to just behind the region of the metatarsal head and being covered by soft expanded plastics, heating at least one blank of thermosoftening expanded plastics for constituting the insole above the softening temperature and inserting it in the shoe, fitting the shoe on the patient's foot, and walking the patient until the insole is below the softening temperature.

2. A kit for producing an insole conforming to a patient's foot comprising a plurality of shoes of various sizes and fittings made of flexible thermosoftening expanded plastics, a plurality of middle sole units for the shoes extending from the heel region to just behind the region of the metatarsal heads and being covered by soft expanded plastics, and a plurality of insole blanks which can be fitted into the shoes, the blanks being of thermosoftening expanded plastics.

3. A kit for producing an insole conforming to a patient's foot comprising a plurality of shoes of various sizes and fittings providing one shoe to be chosen to fit the patient's foot, which shoes each include a middle sole unit extending from the heel region to just behind the region of the metatarsal heads and being covered by soft expanded plastics, and a plurality of insole blanks which can be fitted into the shoes, the blanks being of thermosoftening expanded plastics, providing one blank to fit the shoe chosen for the patient and which may be heated above the softening temperature and inserted into the shoe, the shoe then fitted on the patient's foot, and the patient then walked on the insole until the insole is below the softening temperature.

* * * * *